United States Patent [19]

Ong S. T.

[11] Patent Number: 4,817,311

[45] Date of Patent: Apr. 4, 1989

[54] DECORATIVE BALL DEVICE

[76] Inventor: Raymond Ong S. T., Fl. 7-1, No. 149, Kee Lung Road, Section 1, Taipei, Taiwan

[21] Appl. No.: 133,961

[22] Filed: Dec. 16, 1987

[51] Int. Cl.[4] ..... G09F 19/00

[52] U.S. Cl. ..... 40/410; 40/406

[58] Field of Search ..... 40/406, 407, 409, 410; 446/267, 176; 119/5

[56] References Cited

U.S. PATENT DOCUMENTS

| | | | |
|---|---|---|---|
| 2,435,612 | 2/1948 | Snyder | 40/406 |
| 3,535,805 | 10/1970 | Peiperl | 40/406 |
| 4,215,500 | 8/1980 | Sharp | 40/409 |
| 4,490,931 | 1/1985 | Fleemin | 40/406 |
| 4,612,876 | 9/1986 | Tigert | 119/5 |
| 4,703,720 | 11/1987 | Shipman et al. | 119/5 |

FOREIGN PATENT DOCUMENTS

| | | | |
|---|---|---|---|
| 1083064 | 9/1967 | United Kingdom | 40/410 |

*Primary Examiner*—Robert P. Swiatek
*Assistant Examiner*—Cary E. Stone
*Attorney, Agent, or Firm*—Varndell Legal Group

[57] ABSTRACT

A decorative ball device mainly comprises a transparent hollow sphere which contains a liquid. A puppet together with a plurality of small pieces are disposed in the sphere. The sphere has a pump case and a skirt at its bottom. A sealing ring locates between the inner periphery of the skirt and the outer periphery of the pump case. The sealing ring has a central aperture respectively communicating with an inlet and an outlet channels in the pump case. A supporting plate for supporting the puppet is disposed in the sphere. The supporting plate possesses a pair of holes each communicating with the central aperture. The holes respectively correspond to the outlet and inlet channels. In operation, when a blade in the pump case is driven to rotate by a motor. The pieces along with the liquid are driven to circulate within the sphere thereby creating a both dynamic and attractive effect.

5 Claims, 3 Drawing Sheets

B-B

A-A

DECORATIVE BALL DEVICE

BACKGROUND OF THE INVENTION

The present invention relates to a decorative ball device and more particularly to one which has a transparent hollow sphere containing a liquid, a puppet and a plurality of small pieces such that when the liquid is driven to circulate within the sphere, the pieces may move with the circulating liquid flow to spread throughout the sphere. This may create a dynamic effect to satisfy the user's requirement.

Conventional decorative devices generally provide a static effect. Although some of the recently developed decorative devices provide a dynamic function, such a dynamic function is merely limited to the generation of sound and/or music or to the emission of the light.

It is, therefore, an object of the present invention to provide a brand-new decorative ball device in which a transparent hollow sphere is designed to contain a liquid (such as water), a puppet (such as Santa Claus) and a plurality of small pieces (such as paper piece) such that when the liquid is driven to circulate along the inner wall of the sphere, the pieces may move with the circulating liquid flow and spread throughout the sphere to create a both novel and attractive effect.

SUMMARY OF THE INVENTION

It is the primary object of the present invention to provide a decorative ball device which has a transparent hollow sphere containing a liquid, a puppet and a plurality of small pieces such that when the liquid in the wphere is driven to circulate, the pieces may move with the circulating liquid flow to spread throughout the sphere and thus this provides an attractive effect.

It is another object of the present invention to provide a decorative ball device which possesses both novelty and inventiveness.

It is a further object of the present invention to provide a decorative ball device which is easy to assemble and practical for use.

DETAILED DESCRIPTION OF THE PREFERRED EMBODIMENT

Figure 1:
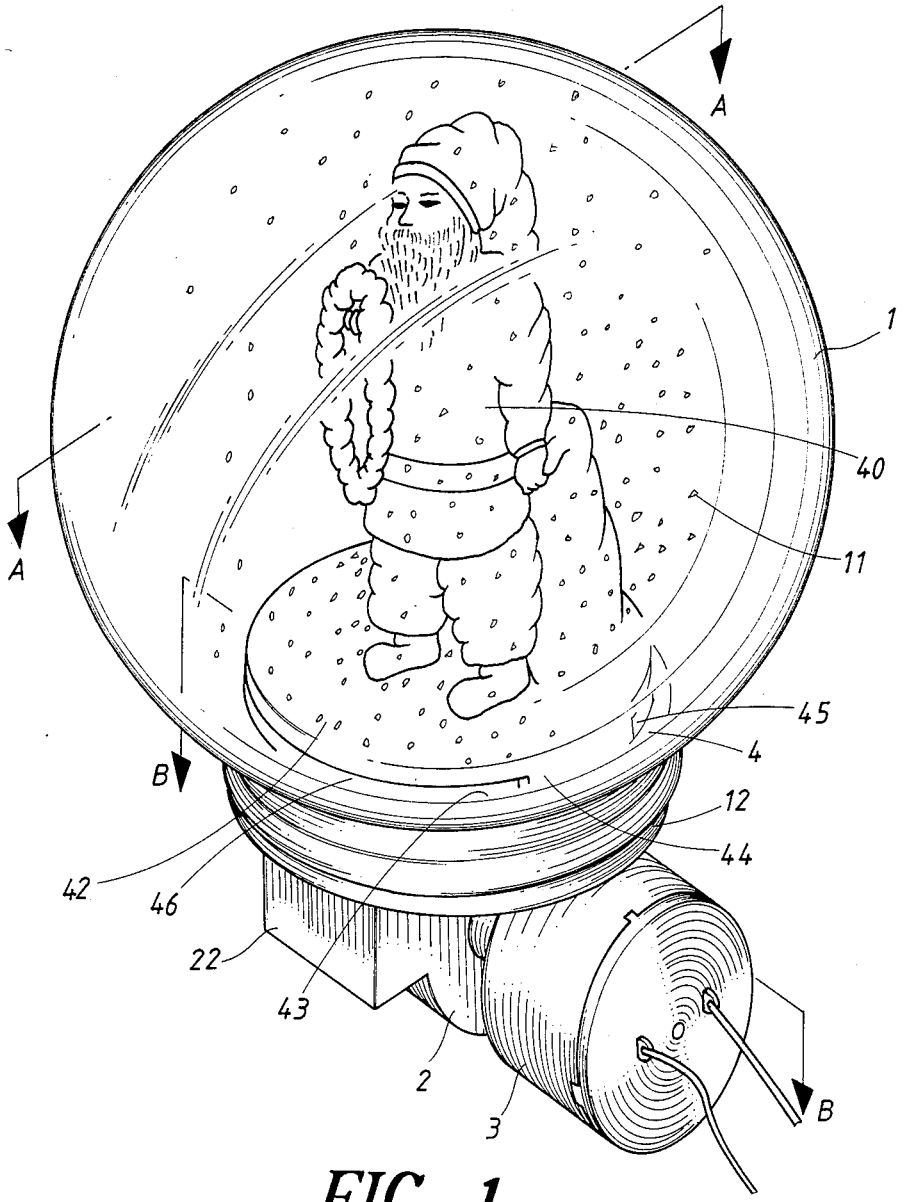
FIG. 1 is a perspective view of a preferred embodiment of the present invention wherein the puppet within the transparent hollow sphere is a Santa Claus.
Figure 2:
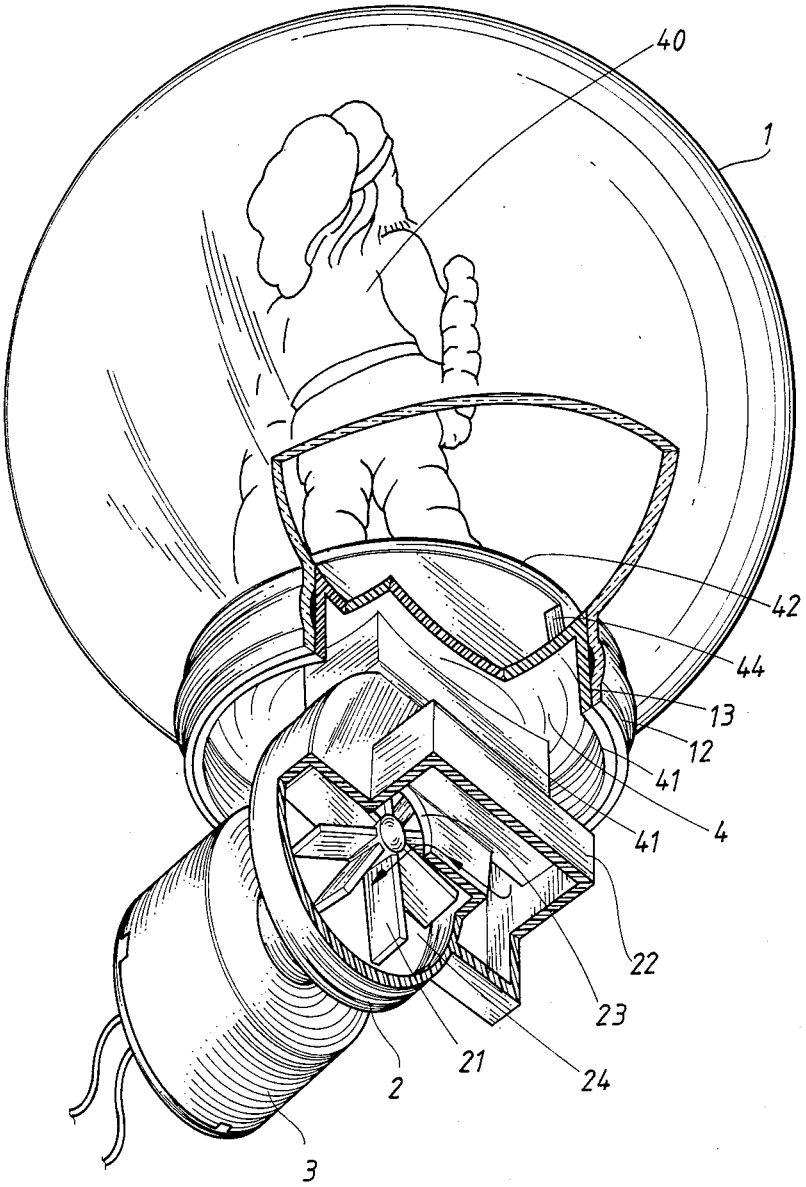
FIG. 2 is a rear view of the present invention wherein the lower portion thereof a partially removed for illustration of the internal construction.
Figure 4:
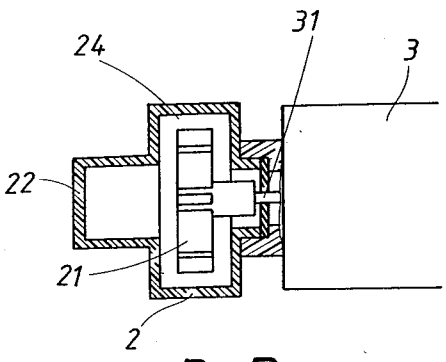
FIG. 4 is a cross-section view taken along the line B—B of FIG. 1, which shows the combination of a motor and a pump case of the present invention.
Figure 3:
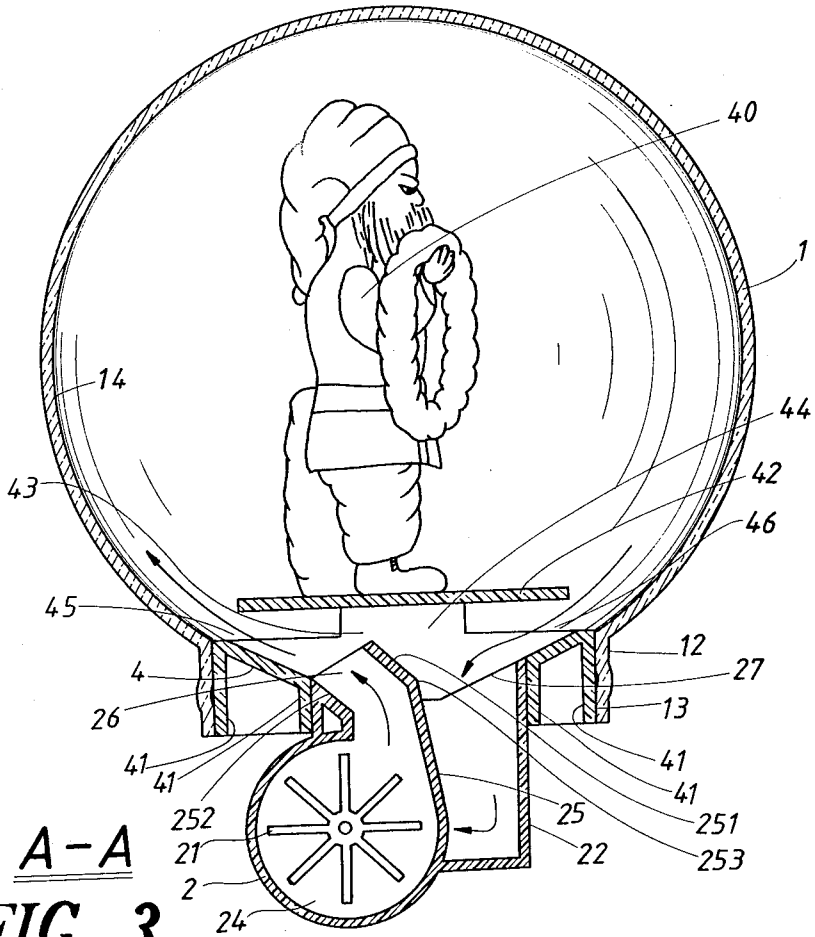
FIG. 3 is a cross-section view taken along the line A—A of FIG. 1, which shows the circulating path of the liquid in the transparent hollow sphere.

Referring to the drawings, a preferred embodiment of the present invention comprises a hollow sphere (1) preferably made of transparent material such as glass. The sphere (1) is arranged to contain a liquid (such as water) as well as a plurality of small pieces (11). Those pieces (11) stay on the bottom of the sphere (1) when the liquid in said sphere is steady. The sphere (1) further is provided at its bottom with a downwardly extending annular skirt (12). The annular skirt (12) has an annular opening (13) formed therein.

A pump case (2) is disposed below the opening (13). The interior of the pump case (2) forms a chamber (24) which receives a blade (21). A guide box (22) is integrally formed with the pump case (2). The guide box (22) communicates with the chamber (24) through a hole (23). A partition (25) locates between the case (2) and the guide box (22). The partition (25) has an inclined portion (251) which cooperates with the inclined portion (252) of the case (2) to form an outlet channel (26). The other side of the partition (25) cooperates with one wall of the guide box (22) to form an inlet channel (27). The bending point (253) of the inclined portion (251) locates around the central line of the sphere (1) such that the outlet channel (26) and the inlet channel (27) respectively locate at each side of the central line of the sphere (1).

A motor (3) is disposed at one side of the case (2) in such a manner that the shaft (31) of the motor (3) is connected with the blade (21) in the case (2).

A sealing ring (4) is disposed between the skirt (12) of the sphere (1) and the pump case (2). The sealing ring (4) has a downward flap (41) which can tightly fit the inner periphery of the skirt (12) and the outer periphery of the pump case (2). The sealing ring (4) has a supporting plate (42) extending into the sphere (1) and a central aperture (43) respectively communicating with the outlet channel (26) and the ilet channel (27). The bottom of the supporting plate (42) has a pair of narrow pieces (44) to form at each side an arcuate hole (45) (46). The top surface of the supporting plate (42) has a puppet (40) extending into the sphere (1). In the preferred embodiment of the present invention, the aforesaid puppet (40) is a Santa Claus.

In assembly, first fill the sphere (1) with liquid. Then, sequentially combine the pump case (2), the motor (3) and the sealing ring (4) with the sphere (1) to complete the present invention.

To facilitate the installation of the present invention, the components extending outwardly from the bottom of the sphere are housed with a base seat such that the present invention can be placed on any suitable location (such as the desk).

In operation, the shaft (31) together with the blade (21) are rotated by the motor (3) such that the liquid in the chamber (24) may be forced into the sphere (1) through the outlet channel (26) and the arcuate hole (45). Then, the liquid flows along the inner arcuate wall (14), through the arcuate hole (46), inlet channel (27), guide box (22), hole (23) and finally into the chamber (24). Such a procedure is continued to establish a circulating liquid flow.

During the liquid circulation, because the outlet channel (26) and the inlet channel (27) approximately locate at each side of the center line of the sphere (1), the liquid in the sphere may achieve a complete circulating effect. Such an arrangement would force the pieces (11) to move with the circulating liquid flow. Therefore, the puppet in the sphere (1), such as the Santa Claus in this case, appears to be surrounded by those pieces (11) which may be deemed as snowflake.

Conclusively, the present invention does provides a dynamic decorative ball device which possesses both novelty and inventiveness. Therefore, the present invention conforms to the requirements of patentability and deserves to be granted an invention patent.

I claim:

1. A decorative ball device comprising:

a transparent hollow sphere with a predetermined diameter, the interior of said sphere containing a liquid and a plurality of small pieces, said sphere having a downwardly extending annular skirt, said annular skirt having an annular opening formed therein;

a pump case being disposed below the annular opening of said skirt, the interior of said pump case having a chamber which receives a blade, a guide box being integrally formed with said pump case, said guide box communicating with said chamber through a hole, said pump case having an outlet channel and an inlet channel at its top portion;

a motor being mounted to one side of said pump case in such a manner that said blade in said pump case is joined with a shaft of said motor;

a sealing ring being disposed between said skirt and said pump case, said sealing ring having a downward flap to tightly fit the inner periphery of said skirt and the outer periphery of said pump case, said sealing ring having a supporting plate which extends into said sphere, said sealing ring further having a central aperture respectively communicating with said outlet channel and inlet channel, said supporting plate having a pair of holes at its bottom and said holes respectively correspond to said outlet channel and said inlet channel, the top surface of said supporting plate having a puppet thereon;

whereby when the liquid is driven to circulate in said sphere by said blade driven by said motor, said pieces may move with the circulating liquid flow to spread throughout said sphere.

2. A decorative ball device as claimed in claim 1, wherein a partition is disposed between said pump case and said guide box, said partition having an inclined portion which cooperates with an inclined portion of said pump case to form an outlet channel, the other side of said partition forming an inlet channel.

3. A decorative ball device as claimed in claim 2, wherein the bending point of said inclined portion of said partition is located around the central line of said sphere such that said outlet channel and said inlet channel respectively are located at each side of said central line.

4. A decorative ball device as claimed in claim 1, wherein said supporting plate of said sealing ring has a pair of narrow pieces to form at each side an arcuate hole to respectively correspond to said outlet and inlet channels.

5. A decorative ball device as claimed in claim 1, wherein at least a portion of said pump case is housed within a base seat for placing said decorative ball device on a flat surface.

* * * * *